US006035835A

United States Patent [19]

Shigihama et al.

[11] Patent Number: 6,035,835

[45] Date of Patent: Mar. 14, 2000

[54] VALVE OPERATION VERIFICATION SYSTEM FOR VERIFYING VALVE OPERATION OF VALVE DISPOSED IN HOT GAS FLOW PASSAGE

[75] Inventors: Shingo Shigihama, Hiroshima; Tetsushi Hosokai, Kure; Tamotsu Kamakura; Katsuhiko Sakamoto, both of Higashihiroshima; Futoshi Nishioka, Hiroshima; Masanobu Kotoku, Higashihiroshima; Kazuhiro Shinmoto, Hiroshima, all of Japan

[73] Assignee: Mazda Motor Corporation, Hiroshima-ken, Japan

[21] Appl. No.: 08/980,442

[22] Filed: Nov. 28, 1997

[30] Foreign Application Priority Data

Nov. 28, 1996 [JP] Japan ..... 8-317610

[51] Int. Cl.[7] ..... F02M 25/07

[52] U.S. Cl. ..... 123/568.16; 73/117.3; 701/108

[58] Field of Search ..... 123/568.16; 73/116, 73/117.3; 701/108

[56] References Cited

U.S. PATENT DOCUMENTS 4,690,120 9/1987 Egle ..... 123/568.16
5,014,203 5/1991 Miyazaki et al. ..... 123/568.16
5,349,936 9/1994 Uchinami ..... 123/568.16
5,474,051 12/1995 Matsumoto et al. ..... 123/568.16
5,727,533 3/1998 Bidner et al. ..... 123/568.16
5,771,869 6/1998 Yoshihara et al. ..... 123/568.16

FOREIGN PATENT DOCUMENTS 6-58210 3/1994 Japan ..... F02M 25/07
8-35449 2/1996 Japan ..... F02M 25/07

*Primary Examiner*—Willis R. Wolfe
*Attorney, Agent, or Firm*—Sidley & Austin; Hugh A. Abrams

[57] ABSTRACT

A valve operation verifying system for making verification of valve operation of an EGR valve of a type having a diaphragm elastically deformable according to operating conditions of an engine to admit controlled amounts of exhaust gas that is recirculated into an intake air stream which verifies, on a basis of gas pressure in an EGR passage, whether the diaphragm remains elastically deformable as specified and whether a pressure sensor remains free from freezing, and executes the verification of valve operation of the EGR valve on a basis of a change in the gas pressure in the EGR passage when the EGR valve opens and when it closes, and when the temperature of ambient air is lower than a critical point, verifying that the diaphragm remains elastically deformable as specified and that said pressure sensor is free from freezing.

14 Claims, 9 Drawing Sheets

VALVE OPERATION VERIFICATION SYSTEM FOR VERIFYING VALVE OPERATION OF VALVE DISPOSED IN HOT GAS FLOW PASSAGE

BACKGROUND OF THE INVENTION

1. Field of the Invention

This invention relates to a verifying system for verifying a shut-off state of a hot gas flow passage, and, in particular, to a valve operation verifying system for verifying opening and closing operation of a gas flow control valve of a type having a valve body and an elastic body deformable in response to engine operating conditions to force the valve body to control amounts of gas admitted to flow through a hot gas flow passage, such as an exhaust gas recirculation passage of an exhaust gas recirculation system installed on an automobile engine.

2. Description of the Related Art

Typically, fluid flow passages are variably opened and closed by a regulation valve which is forced by an elastic body deformable in response to changes in pressure. As shown in, for example, Japanese Unexamined Patent Publication No. 6-58210, such a regulation valve is installed in the form of pressure modulated exhaust gas recirculation valve to a hot exhaust gas recirculation passage to control amounts of exhaust gas that is recirculated into an intake air stream. The Japanese Unexamined Patent Publication No. 6-58210 mentioned above also teaches verification of opening and closing valve operation of the exhaust gas recirculation valve on a basis of a change in gas pressure in the exhaust gas recirculation passage caused before and after momentarily opening or closing of the exhaust gas recirculation valve. In the cases where the gas circulation passage incorporates an exhaust gas recirculation valve of the type having a valve body and an elastic body which is elastically deformable to force the valve body to open and close the exhaust gas recirculation passage, verification of opening and closing operation of the exhaust gas recirculation valve is interrupted while the temperature of ambient air is lower than a specified temperature of, for example, 10° C., which is a critical point for low temperature hardening of the elastically deformable body, and in such cases the verification of the opening and closing of the valve operation is inaccurate.

Even if the temperature of ambient air is low and the elastic body possibly loses its specified elasticity or flexibility, the elastically deformable body incorporated in the exhaust gas recirculation passage can be warmed up with hot exhaust gas somewhat sufficiently to be elastically deformable or flexible as specified, in the event of which unconditional interruption of the verification of valve operation results in less chance to execute the verification of valve operation and causes a problem in the early detection of an operational failure of the exhaust gas recirculation valve.

SUMMARY OF THE INVENTION

It is an objective of this invention to provide a valve operation verification system for verifying operation of a pressure controlled gas flow control valve of a type having a valve body and an elastic body deformable to force the valve body to variably open and close a gas flow passage so as thereby to admit controlled amounts of hot gas to flow in the gas flow passage.

It is another object of this invention to provide a valve operation verification system for verifying opening and closing operation of an exhaust gas recirculation valve of a type having a valve body and a pressure regulated elastic body, such as a pressure modulated diaphragm, elastically deformable to force the valve body to variably open and close an exhaust gas recirculation passage so as thereby to admit controlled amounts of exhaust gas to be recirculated into an intake air stream, which is able to perform early detection of an operational failure of the exhaust gas recirculation valve even if the temperature of ambient air is lower than a critical point at which the elastic body loses the elasticity or flexibility as desired.

The foregoing objects of the present invention are achieved by providing a valve operation verifying system for verifying opening and closing of, for example, an exhaust gas recirculation passage with a gas flow control means such as a valve of a type, for example, having a pressure controlled elastically deformable body or diaphragm to force a valve body to variably open and close the exhaust gas recirculation passage. The valve operation verifying system detects the temperature of ambient air, verifies whether the elastically deformable body remains flexible or elastic as specified, and executes verification of opening and closing operation of the gas flow control valve on a basis of a shut-off state of the gas recirculation passage while the temperature of ambient air is lower than a specified critical point, it is verified that the gas flow control valve remains flexible as specified.

The valve operation verifying system may includes a pressure detecting means for detecting gas pressure in the gas recirculation passage downstream from the gas flow control valve, in such case the valve operation verifying system verifies whether the pressure detecting means is frozen abnormally operative, and executes the verification of valve operation on a basis of a change in the gas pressure in the gas recirculation passage while the gas flow control means remains open and while remaining closed when further verifying that the pressure detecting means is free from freezing. The verification of valve operation may executed when further verifying that the temperature of engine cooling water is higher the a specified critical point.

The verification as to whether the elastically deformable body remains flexible or elastic as specified may be made by utilizing a target opening of the gas flow control valve which is varied according to an engine operating conditions. That is, it is verified that the elastically deformable body remains flexible or elastic as specified while the engine operates under conditions that either an actual valve opening or the target valve opening remains greater than a prescribed critical point for a time period longer than a specified time period, and the difference between these actual valve opening and target valve opening is within specified limits. It may be verified that the elastically deformable body remains flexible or elastic as specified when either the actual valve opening or the target valve opening remains greater than a prescribed critical point for a time period longer than a specified time period. Otherwise, it may be verified that the elastically deformable body remains flexible or elastic as specified when a difference between these actual valve opening and target valve opening is within specified limits.

With the valve operation verifying system of the invention, even in the event where, the temperature of ambient air is so low that the elastic body possibly loses the specified flexibility or elasticity, it is verified that the elastic body remains flexible, the verification of valve operation is executed. In particular, in the case that the valve operation verification is made for an exhaust gas recirculation valve of the exhaust gas recirculation system of an engine, the pressure controlled diaphragm easily regains the specified flexibility or elasticity even if the temperature of ambient air is critically low, in the event of which the verification of operation of the exhaust gas recirculation valve is executed at increased times.

The pressure of exhaust gas that is recirculated into the intake passage and detected by the pressure detecting means is higher while the exhaust gas recirculation valve is in the full position than while it is in the closed position. The utilization of the pressure detecting means makes it quite easy to verify valve operation of the exhaust gas recirculation valve. It is verified that the elastically deformable body remains flexible or elastic as specified when the engine operates under the condition that an actual valve opening or a target valve opening remains greater than a prescribed critical point for a time period longer than a specified time period and a difference between these actual valve opening and target valve opening is within specified limits. Otherwise, it is verified that the elastically deformable body remains flexible or elastic as specified either when an actual valve opening or a target valve opening remains greater than a prescribed critical point for a time period longer than a specified time period, or when a difference between these actual valve opening and target valve opening is within specified limits. Further, the verification of valve operation is executed on the condition that the elastically deformable body remains flexible or elastic as specified and the pressure detecting means remains normally operative even when the temperature of ambient air is lower than the critical point.

Accordingly, the verification of operation of the gas flow control valve is executed at increased times with high accuracy even when the temperature of ambient air is critically low, so as to yield early detection of an operational failure of the gas flow control valve.

BRIEF DESCRIPTION OF THE DRAWINGS

The foregoing and other objects and features of the present invention will be clearly understood from the following detailed description of preferred embodiments when read in conjunction with the accompanying drawings in which.

DETAILED DESCRIPTION OF THE PREFERRED EMBODIMENT

Figure 1:
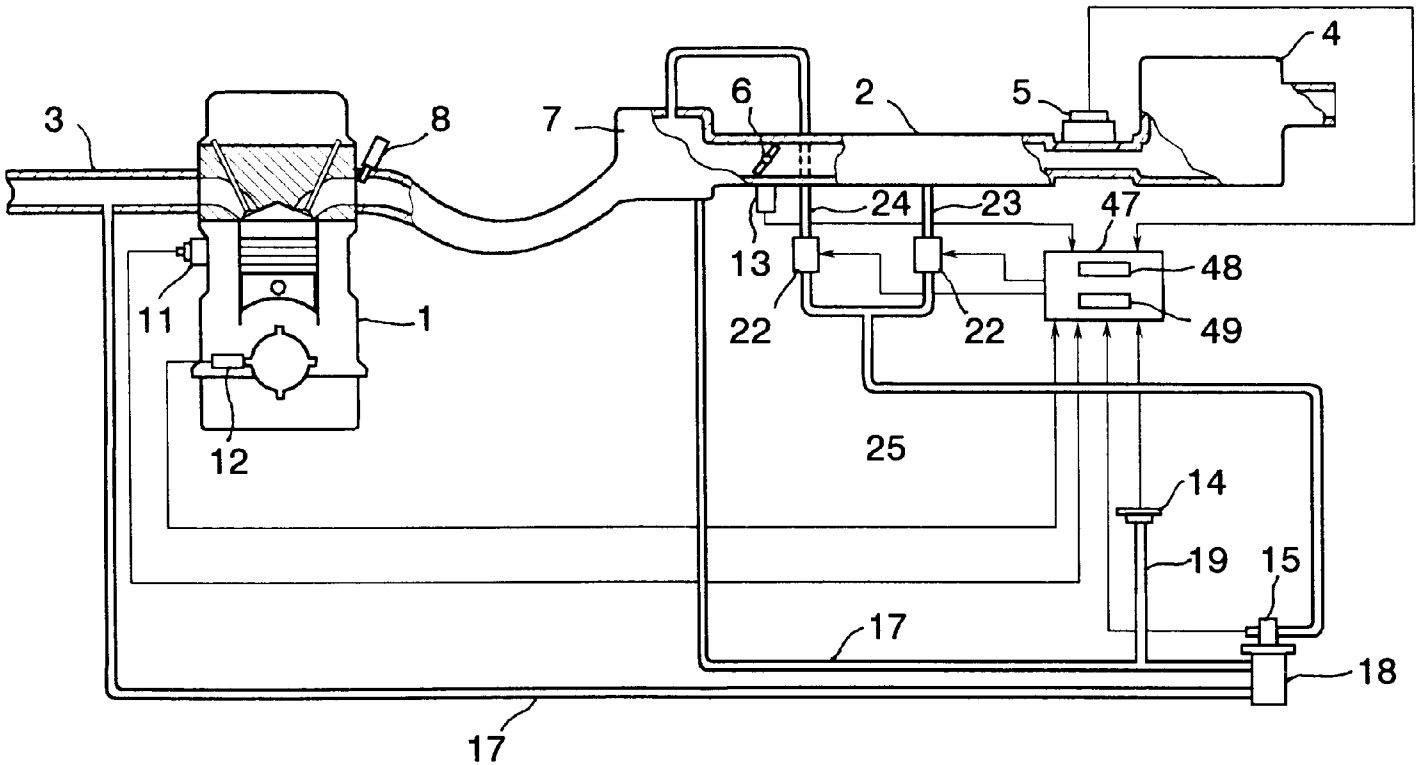
FIG. 1 is a schematic illustration showing an exhaust gas recirculation system equipped with a valve operation verifying system for use with an automobile engine in accordance with an embodiment of the present invention.

Referring to the drawings in detail, in particular, to FIG. 1, an exhaust gas recirculation system, having an exhaust gas recirculation passage 17 equipped with a system for verifying valve operation of an exhaust gas recirculation valve in accordance with an embodiment of the invention, for use with an automobile engine 1. The exhaust gas recirculation system is interposed between an intake passage 2 and an exhaust passage 3 of the engine 1. The intake passage 2 is provided, from the upstream end, with an air cleaner 4, an air flow meter or sensor 5, a throttle valve 6, a surge tank 7 and fuel injectors 8 (only one of which is shown). The engine 1 incorporates a temperature sensor 11 to detect the temperature of engine cooling water and a speed sensor 12 to detect the rotational speed of engine 1. A throttle sensor 13 is provided in close proximity to the throttle valve 6 to detect opening or position of the throttle valve 6. All these devices and meters or sensors are known in various types in the art and may take any well known types, respectively. The air flow sensor 5 may preferably be of a hot-wire type comprising a wire and an air temperature sensor. As known in the art, this hot-wire type of air flow sensor detects the amount of intake air flowing therethrough by detecting electric resistance of the wire which is changeable in response to a change in the amount and the temperature of air introduced into the intake passage 2.

Exhaust gas recirculation passage 17, which is interposed between the surge tank 7 and upstream part of the exhaust passage 3 to communicate them with each other, incorporates a switching valve 18 as an exhaust gas recirculation (EGR) valve and a pressure sensor 14. The exhaust gas recirculation (EGR) valve 18 connects and disconnects circulation of exhaust gas between the surge tank 7 and the exhaust passage 3 or opens and closes the exhaust gas recirculation passage 17. The pressure sensor 14 is attached to one end of a branch passage 19 branching off from a downstream part of the exhaust gas recirculation passage 17 between the surge tank 7 and the exhaust gas recirculation (EGR) valve 18 to detect the internal gas pressure in the downstream part of the exhaust gas recirculation (EGR) valve 18. Intake passage 2 is provided with an atmospheric pressure passage 23 equipped with a solenoid valve 22*a* for introducing fresh air into part of the intake passage 2 upstream from the throttle valve 6 and a negative pressure passage 24 with a solenoid valve 22*b* for introducing negative pressure or vacuum into the surge tank 7 downstream from the throttle valve 6. These passages 23 and 24 are jointly connected to a common passage 25 leading to the exhaust gas recirculation (EGR) valve.

Figure 2:
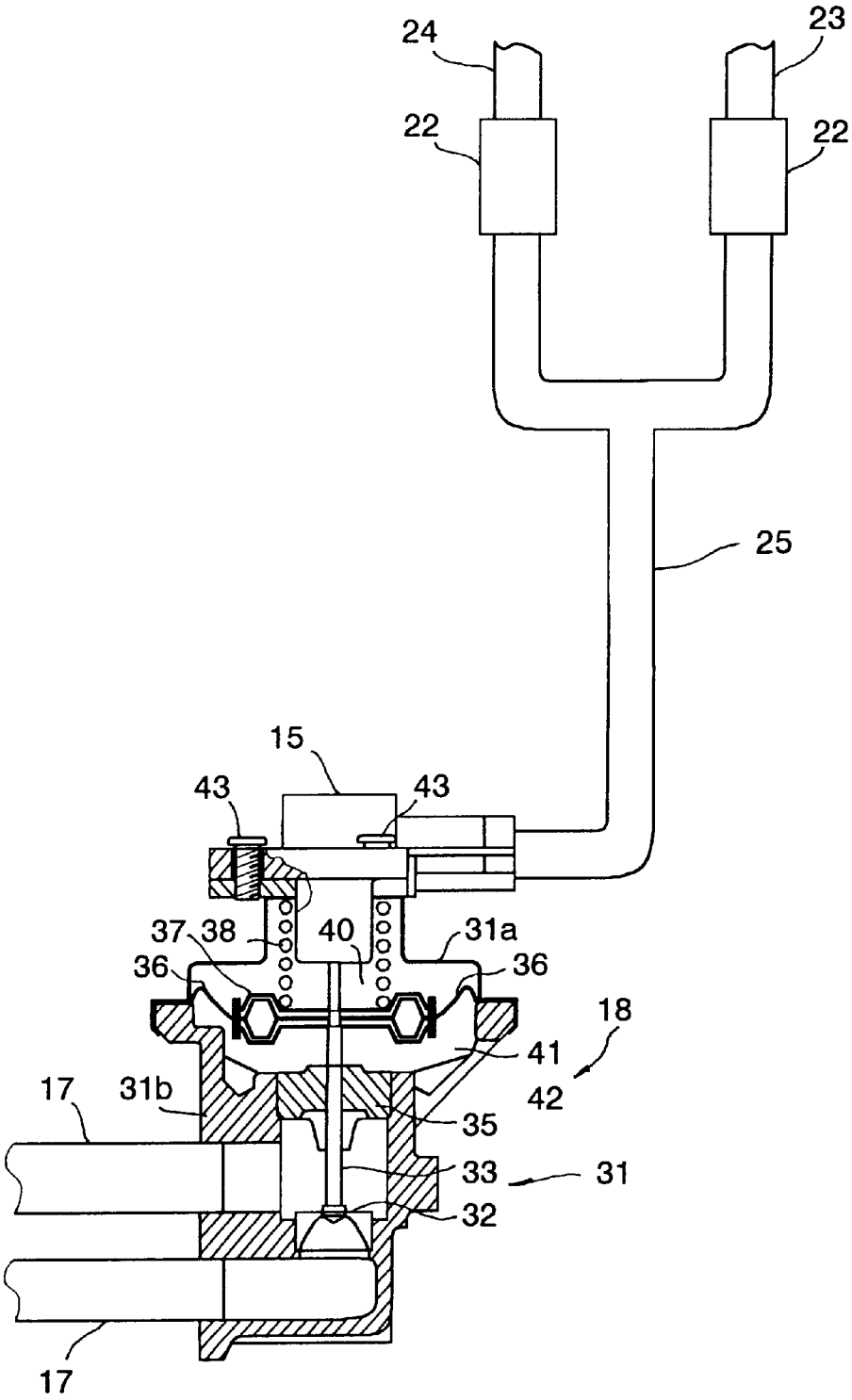
FIG. 2 is a cross-sectional view of an exhaust gas recirculation (EGR) valve incorporated into the exhaust gas recirculation system.

FIG. 2 shows details of the exhaust gas recirculation (EGR) valve 18. As shown in FIG. 2, the exhaust gas recirculation (EGR) valve 18 has a housing 31 comprising an upper housing section 31*a* and a lower housing section 31*b*. The upper housing section 31*a* forms an upper pressure chamber 40 which is in communication with the common passage 25, and the lower housing section 31*b* forms part of the exhaust gas recirculation passage 17 and a lower pressure chamber 41 which is in communication with the atmosphere through an opening 41 and is formed with a valve seat 32. A valve, such as a pintle valve 33, is supported for up and down slide movement by means of a bearing 35. When the pintle valve 33 moves downward and is received by the valve seat 32, it closes the exhaust gas recirculation passage 17 to shut-off circulation of exhaust gas between the exhaust passage 3 and the surge tank 7. The exhaust gas recirculation (EGR) valve 18 incorporates a pressure controlled diaphragm 36, by which the upper and lower pressure chambers 40 and 41 are separated, to actuate the pintle valve 33. The diaphragm 36 of a type of disk-shaped elastic member is made of, for example, fluorine rubber and is interposed between disk plates 37 and secured at its periphery between the upper and lower housing sections 31*a* and 31*b*. A diaphragm spring 38 is disposed between the diaphragm 36 and the top wall of the housing 31 to force the pintle valve 33 toward the closed position when no exhaust gas flow is admitted to take place. While the diaphragm 36 is in its extremely downward position, it does not produce tension by itself. A position sensor 15 is attached to the top of the housing 31 by means of set screws 43 to detect a vertical lift position of the pintle valve 33 which indicates the degree of opening of the gas flow control valve 18.

Solenoid valves 22*a* and 22*b* are controlled to regulate their opening to vary the quantitative ratio between atmospheric pressure and negative pressure introduced into the upper pressure chamber 40 through the atmospheric pressure passage 23 and the negative pressure passage 24, respectively. A change in pressure in the upper pressure chamber 40 forces the diaphragm 36 upward against the diaphragm spring 38 to open the pintle valve 33 upwardly. Specifically, the pintle valve 33 is shifted upwardly higher as the pressure in the upper pressure chamber 40 increases, so as to increase the amount of gas flow in the exhaust gas recirculation passage 17 passing through the pintle valve 33.

The valve operation verifying system for the exhaust gas recirculation passage 17 incorporates a control unit 47 having a microcomputer including a read only memory (ROM) and a random access memory (RAM) to which signals are sent from various sensors 5, 11, 12, 13, 14 and 15 and from which duty control signals are provided for the solenoid valves 22. Each solenoid valve 22 is operated to open according to a duty ratio indicated by the duty control signal, so as to regulate the pressure in the upper pressure chamber 40 of the exhaust gas recirculation (EGR) valve 18. As a result of changes in pressure in the upper pressure chamber 40 of the exhaust gas recirculation (EGR) valve 18, the pintle valve 33 is forced up and down to control the amount of exhaust gas that is recirculated into the intake passage 2.

Control unit 47 functionally comprises a freezing monitoring means for monitoring freezing of the pressure sensor 14 and an operation monitoring means for monitoring valve operation of the exhaust gas recirculation (EGR) valve 18, more specifically the elasticity or flexibility of the diaphragm 36. Monitoring of valve operation of these pressure sensor 14 and exhaust gas recirculation (EGR) valve 18 are executed at specified times, for example, 20 seconds after activation of the engine 1 by means of an ignition key switch (not shown).

Figure 3:
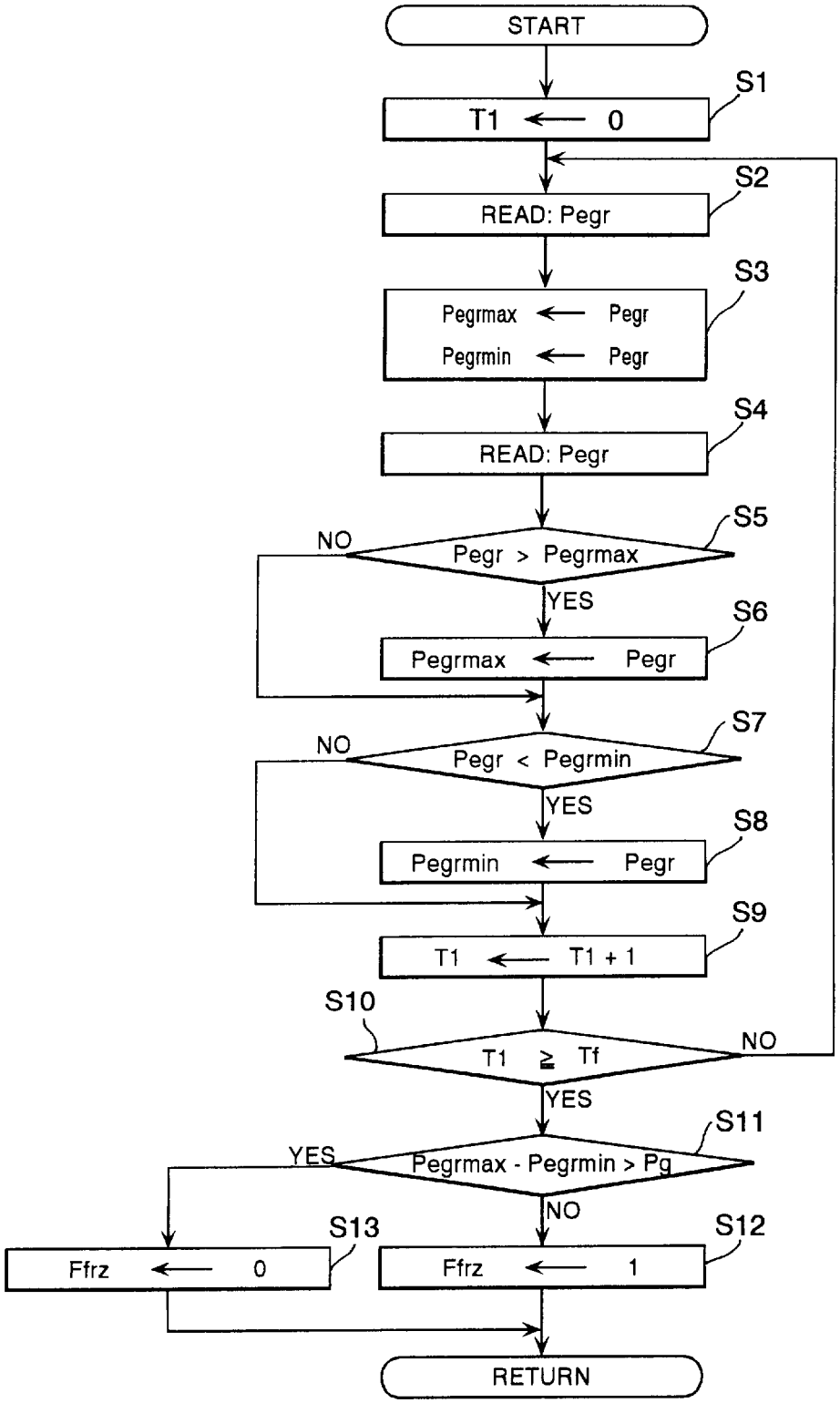
FIG. 3 is a flow chart illustrating a sequence routine of verifying operation of a pressure sensor of the exhaust gas recirculation system.

Monitoring of the valve operation of the pressure sensor 14 by means of the monitoring means is performed following a sequential routine for the programmed microcomputer illustrated by a flow chart in FIG. 3.

Referring to FIG. 3, when the flow chart logic commences, after resetting the timer count T1 of a timer to 0 (zero), which timer count T1 indicates a lapse of time at step S1, a pressure Pegr in the exhaust gas recirculation passage 17 is read in on a basis of a signal from the pressure sensor 17 at step S2 and provisionally stored as a maximum pressure Pegrmax and a minimum pressure Pegrmin at step S3. Subsequently, a current exhaust gas pressure Pegr in the exhaust gas recirculation passage 17 is read in again on the basis of a signal from the pressure sensor 17 at step S4. These data are sampled at regular intervals of, for example, 20 ms. Thereafter, determinations are subsequently made to decide whether the condition for execution of verification of valve operation of the pressure sensor 14 has been satisfied at steps S5 through S11. The exhaust gas pressure Pegr is substituted for the maximum pressure Pegrmax if it is decided to be greater than the maximum pressure Pegrmax at step S6 as a result of a comparison made at step S5, or for the maximum pressure Pegrmax if it is decided to be greater than the maximum pressure Pegrmax at step S8 as a result of a comparison made at step S7.

Subsequently, after changing the timer count T1 by an increment of 1 (one) which represents a specified time at step S9, a determination is made at step S10 as to whether the timer count T1 is greater than a specified time Tf. If the answer to the determination is "NO," the flow chart logic returns to the function block at step S4 to read in another current exhaust gas pressure Pegr in the exhaust gas recirculation passage 17 on a basis of a signal from the pressure sensor 17 at step S4 and the same procedure of steps S4 through S10 is repeated. Specifically, a current exhaust gas pressure Pegr is continuously detected until the specified time Tf is completed. The maximum pressure Pegrmax is replaced with a maximum value of the exhaust gas pressure Pegr detected within the specified time Tf, and the minimum pressure Pegrmin is replaced with a minimum value of the exhaust gas pressure Pegr detected within the specified time Tf.

On the other hand, if the answer to the determination made at step S10 is "YES," then, another determination is made at step S11 as to whether the greatest difference between the maximum pressure Pegrmax and the minimum pressure Pegrmin is greater than a prescribed critical point Pg which may be approximately 0 (zero). This determination is made to determine operating condition of the pressure sensor 14. That is, it is concluded that the pressure sensor 14 is frozen when the greatest difference within a specified time period, i.e. the specified time Tf, is smaller than the prescribed critical point Pg, or that the pressure sensor 14 is operating normally when the greatest difference within a specified time period, i.e. the specified time Tf, is greater than the prescribed critical point Tg. The flow chart logic returns for another control after setting up a freeze flag Ffrz at step S12 when the greatest difference is smaller than the prescribed critical point Tg or after resetting down the freeze flag Ffrz at step S13 when the greatest difference is greater than the prescribed critical point Tg.

Figure 4:
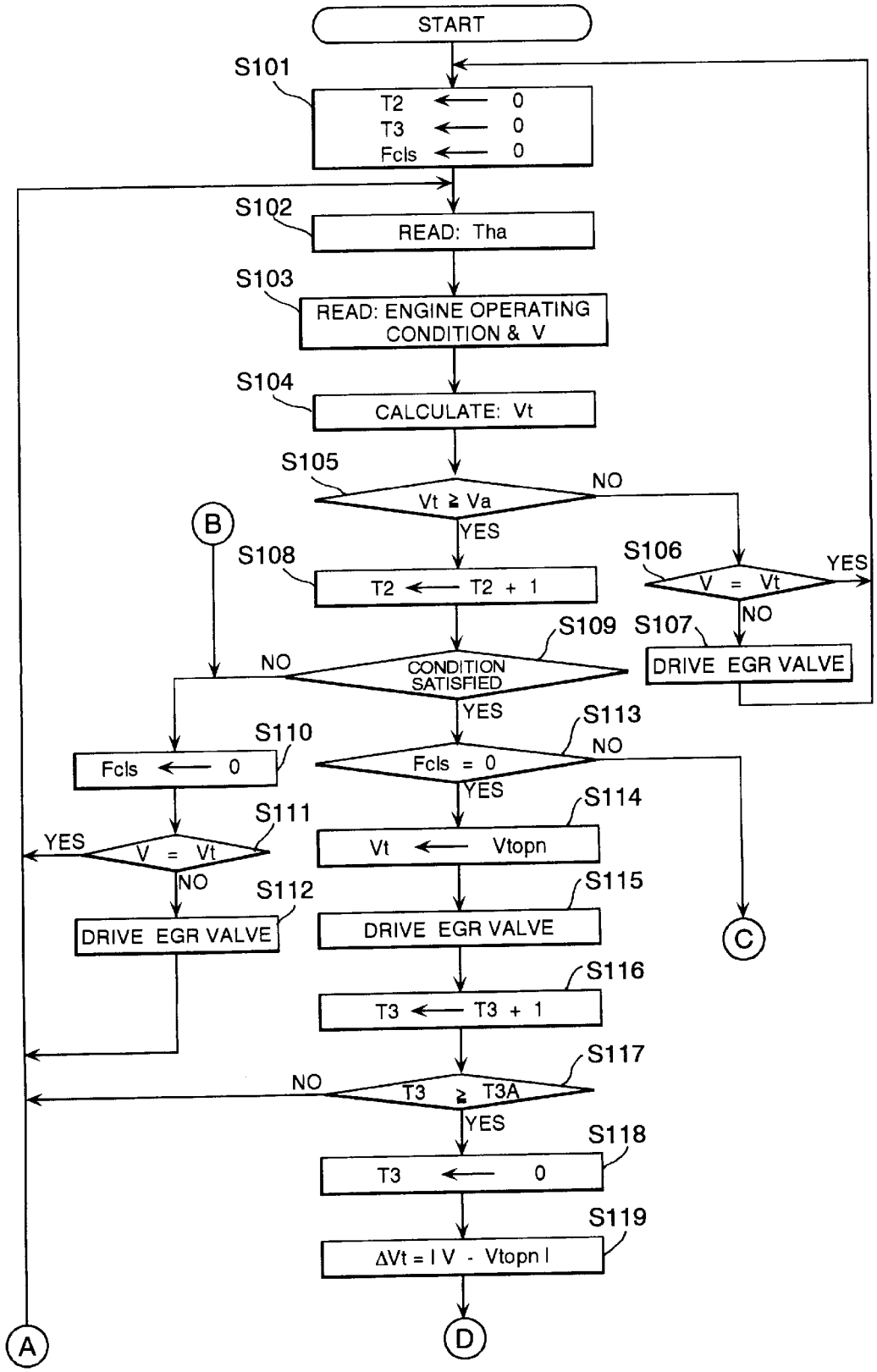
FIGS. 4 and 5 are a flow chart illustrating a sequence routine of verifying operation of the exhaust gas recirculation valve.
Figure 5:
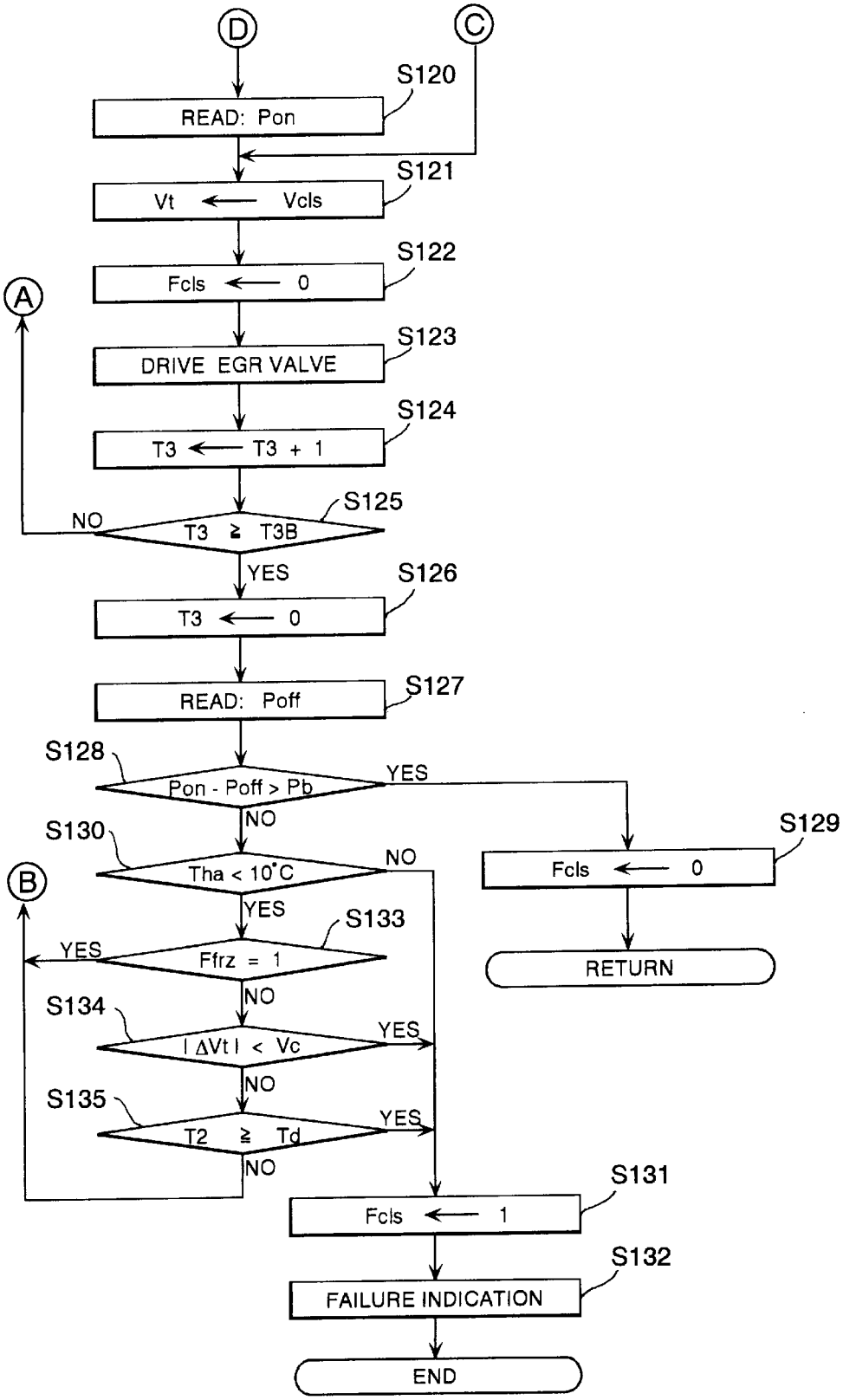

Monitoring of the opening and closing valve operation of the exhaust gas recirculation (EGR) valve 18 made by means of the valve monitoring means is performed following a sequential routine for the programmed microcomputer of the control unit 47 illustrated by a flow chart in FIGS. 4 and 5. The opening and closing valve operation of the exhaust gas recirculation (EGR) valve 18 is determined to be normal or at failure in valve operation on a basis of a change in pressure Pegr in the exhaust gas recirculation passage 17 which is detected by means of the pressure sensor 17. Specifically, the pressure sensor 14 detects pressure in the surge tank 7 that is negative while the exhaust gas recirculation (EGR) valve 18 remains closed to shut-off the exhaust gas recirculation passage 17, or detects significantly high pressure that is circulated into the exhaust gas recirculation passage 17 from the exhaust passage 3 while the exhaust gas recirculation (EGR) valve 18 remains open to open the exhaust gas recirculation passage 17. On the basis of a change in the pressure monitored by the monitoring means while the exhaust gas recirculation (EGR) valve 18 remains open and while it remains closed, it is determined whether the exhaust gas recirculation (EGR) valve 18 opens and closes normally or abnormally.

Specifically, as shown in FIGS. 3 and 4, when the flow chart logic commences and control proceeds to a function block at step S101 where timer counts T2 and T3, each of which indicates a time lapse, are reset to 0 (zero), and a valve position flag Fcls is reset down or to a state of zero (0). In this instance, the valve position flag Fcls is set up or set to a state of "1" when the exhaust gas recirculation (EGR) valve 18 is to remain closed. Subsequently, after reading in the temperature Tha of intake air passing through the air flow sensor 5 on a basis of a signal from the air flow sensor 5 at step S102, a current engine operating condition and a vertical lift position or opening of the exhaust gas recirculation (EGR) valve 18 are detected on a basis of signals from the air-flow sensor 5, the water temperature sensor 11, the engine speed sensor 12 and the throttle position sensor 13, and a basis of a signal from the position sensor 15, respectively, at step S103. After calculating target valve opening Vt of the exhaust gas recirculation (EGR) valve 18 according to the engine operating condition at step S104, a determination is made at step S105 as to whether the target valve opening Vt is equal to or greater than a prescribed critical point Va which is an opening critical to a decision of hardening of the diaphragm 36 due to low temperatures. If the target valve opening Vt is smaller than the prescribed critical point Va, another decision is made at step S106 as to whether the exhaust gas recirculation (EGR) valve 18 has actual valve opening V equal to the target valve opening Vt. The exhaust gas recirculation (EGR) valve 18 is driven until it is actually opened to the target valve opening Vt at step S107. When the exhaust gas recirculation (EGR) valve 18 is actually opened to the target valve opening Vt, the flow chart logic returns and restarts the sequence routine from step S101.

On the other hand, if the target valve opening Vt is equal to or greater than the prescribed critical point Va, after changing the timer count T2 by an increment of 1 (one) at step S108, a determination is made at step S109 as to whether a condition for execution of verification of opening and closing valve operation of the exhaust gas recirculation (EGR) valve 18 has been satisfied. This execution condition is satisfied when, a prescribed critical amount of gas flow is circulated, i.e. the actual valve opening V is greater than the prescribed critical point Va and the temperature of the engine cooling water is higher than a prescribed critical point, various parameters such as an engine speed changing rate, a throttle opening changing rate and an air charging efficiency changing rate which is calculated on a basis of an amount of intake air and an engine speed are less than critical points, respectively. If the execution condition is not yet satisfied, after resetting down the valve position flag Fcls at step S110, another decision is made at step S11 as to whether the exhaust gas recirculation (EGR) valve 18 has actual valve opening V equal to the target valve opening Vt. The exhaust gas recirculation (EGR) valve 18 is driven until it is actually opened to the target valve opening Vt at step S112. When the exhaust gas recirculation (EGR) valve 18 is actually opened to the target valve opening Vt, the flow chart logic returns and restarts the sequence routine from step S102.

If the execution condition is satisfied, a determination is made at step S113 as to whether the valve position flag Fcls is reset down. If the answer to the determination is "YES," this indicates that the exhaust gas recirculation (EGR) valve 18 remains closed, then, at step S114, the target valve opening Vt is replaced with a prescribed monitoring target valve opening Vtopn which is greater than the prescribed critical point Va and has a value closer to the greatest or full valve opening. Subsequently, the exhaust gas recirculation (EGR) valve 18 is driven until it opens to the monitoring target valve opening Vtopn at step S115. After changing the timer count T3 by an increment of 1 (one) at step S116, the timer count T3 is compared to a specified time T3A at step S117. If the timer count T3 indicates a time lapse less than the specified time T3A, the flow chart logic returns and restarts the sequence routine from step S102. That is, until the specified time T3A lapses, the flow chart logic does not proceed to the following steps. On the other hand, if the timer count T3 indicates a time lapse equal to or greater than the specified time T3A, after resetting the timer count T3 to 0 (zero) at step S118, a deviation ΔVt of the actual valve opening V from the monitoring target valve opening Vtopn and the pressure Pon in the exhaust gas recirculation passage 17 with the exhaust gas recirculation (EGR) valve 18 remaining open are read in at steps S119 and S120, respectively. Thereafter, at step S121, the target valve opening Vt is changed to the smallest valve opening Vcls of the exhaust gas recirculation (EGR) valve 18 at the closed position. If the answer to the determination regarding the valve position flag Fcls made at step S113 is "NO," this indicates that the exhaust gas recirculation (EGR) valve 18 remains open, then, the flow chart logic skips steps S114 through S120 and proceeds to step S121 to change the target valve opening Vt to the smallest valve opening Vcls of the exhaust gas recirculation (EGR) valve 18 at the closed position.

Subsequently to changing the target valve opening Vt to the smallest valve opening Vcls of the exhaust gas recirculation (EGR) valve 18 at the closed position at step S121 and setting up the valve position flag Fcls at step S122, the exhaust gas recirculation (EGR) valve 18 is driven to close at step S123, and the timer count T3 is changed by an increment of 1 (one) at step S124. At step S125, the timer count T3 is compared to a specified time T3B. If the timer count T3 indicates a time lapse less than the specified time T3B, the flow chart logic returns and restarts the sequence routine from step S102. In the other sequence routine, because of the "NO" answer to the decision made at step S113, the flow chart logic skips to step S121 to change the target valve opening Vt to the smallest valve opening Vcls of the exhaust gas recirculation (EGR) valve 18 at the closed position. That is, the specified time T3B is a time necessary until the exhaust gas recirculation (EGR) valve 18 fully closes.

If the specified time T3B has lapsed, i.e. the answer to the decision made at step S125 is "YES," then, after resetting the timer count T3 to 0 (zero) at step S126, the pressure Poff in the exhaust gas recirculation passage 17 with the exhaust gas recirculation (EGR) valve 18 remaining closed is read in at steps S127. A determination is subsequently made at step S128 as to whether the difference of the pressure P in the exhaust gas recirculation passage 17 between while the exhaust gas recirculation (EGR) valve 18 remains open and while the exhaust gas recirculation (EGR) valve 18 remains closed is compared to a prescribed critical point Pb. If the pressure difference (Pon−Poff) is greater than the prescribed critical point Pb, it is concluded that the exhaust gas recirculation (EGR) valve 18 is normal in valve operation, and then, at step S129, a valve operation flag Fcls is reset down or reset to a state of "0" which indicates that the exhaust gas recirculation (EGR) valve 18 is normal in opening and closing valve operation. This is because, when the exhaust gas recirculation (EGR) valve 18 is normal in valve operation and is free from foreign particles between the valve seat 32 and the pintle valve 33 of the pintle valve 33, the exhaust gas recirculation (EGR) valve 18 has an actual valve opening V approximately equal, or otherwise extremely close, to the monitoring target valve opening Vtopn; the pressure in the exhaust gas recirculation passage 17 is always greater while the exhaust gas circulates than while the exhaust gas recirculation (EGR) valve 18 is fully closed. On the other hand, if the pressure difference (Pon−Poff) is smaller than the prescribed critical point Pb, another determination is made at step S130 as to whether the temperature of intake air passing through the air flow sensor 5 is lower than a prescribed critical point, for example in this embodiment, 10° C. If the temperature of intake air Tha is higher than the prescribed critical point of 10° C., the valve operation flag Fcls is set to a state of "1," which indicates that the exhaust gas recirculation (EGR) valve 18 is at failure in opening and closing valve operation at step S131. Thereafter, after making an indication of a failure in valve operation by means of, for example, an alarm lamp at step S132, the flow chart logic terminates the sequence routine. The reason for examining the temperature of intake air Tha is that, although it can be decided on the basis of whether the pressure Pon in the exhaust gas recirculation passage 17 with the exhaust gas recirculation (EGR) valve 18 remaining open is almost equal to the pressure Poff in the exhaust gas recirculation passage 17 with the exhaust gas recirculation (EGR) valve 18 remaining closed that the exhaust gas recirculation (EGR) valve 18 is at failure in valve operation, there is the possibility of an operational failure of the exhaust gas recirculation (EGR) valve 18 due to low temperature hardening of the diaphragm 36 or loss in flexibility of the diaphragm 36 and/or the possibility of freezing of the pressure sensor 14 if the temperature of intake air Tha is lower than the prescribed critical point of 10° C. If the temperature of intake air Tha is higher than the prescribed critical point of 10° C., it is concluded that the exhaust gas recirculation (EGR) valve 18 is at failure in valve operation due either to causes other than hardening of the diaphragm 36 or to clogging between the valve seat 32 and the pintle valve 33.

When the temperature of intake air Tha is lower than the prescribed critical point of 10° C., a determination is made at step S133 as to whether the freeze flag Ffrz has been set to the state of "1" which indicates that the pressure sensor 14 has frozen abnormally operative. If the answer to the determination is "YES," the flow chart logic repeats the sequence routine from step S110 where the valve position flag Fcls is reset down. That is, because, in the case where the pressure sensor 14 has frozen abnormally operative, neither the pressure Pon in the exhaust gas recirculation passage 17 with the exhaust gas recirculation (EGR) valve 18 remaining open nor the pressure Poff in the exhaust gas recirculation passage 17 with the exhaust gas recirculation (EGR) valve 18 remaining closed are correctly detected, the sequence routine of monitoring of opening and closing valve operation of the exhaust gas recirculation (EGR) valve 18 is repeated from step S102 without executing further determinations regarding other causes of an operational failure of the exhaust gas recirculation (EGR) valve 18. On the other hand, when the answer to the determination regarding the freeze flag Ffrz made at step S133 is "NO," a determination is made at step S134 as to whether the absolute value of the deviation ΔVt of the actual valve opening V from the monitoring target valve opening Vtopn is smaller than a prescribed critical point Vc. When the absolute value of the deviation ΔVt is smaller than a prescribed critical point Vc, it is concluded that, though the temperature of intake air Tha is lower than the prescribed critical point of 10° C., the exhaust gas recirculation (EGR) valve 18 operates normally with the diaphragm 36 remaining elastically deformable or flexible and has, however, gotten clogged with foreign particles between the valve seat 32 and the pintle valve 33 of the gas flow control valve 18. Then, the valve operation flag Fcls is set to a state of "1" which indicates that the exhaust gas recirculation (EGR) valve 18 is at failure in opening and closing valve operation at step S131. After making an indication of a failure in valve operation by means of the alarm lamp at step S132, the flow chart logic terminates the sequence routine. On the other hand, when the answer to the determination made at step S134 is "NO," another determination is made at step S135 as to whether the timer count T2 is greater than a specified time T2D which is set forth between, for example, two to five seconds. When the timer count T2 exceeds the specified time T2D, the valve operation flag Fcls is set to a state of "1" at step S131. After making an indication of a failure in valve operation by means of the alarm lamp at step S132, the flow chart logic terminates the sequence routine. On the other hand, when the timer count T2 remains less than the specified time T2D, the flow chart logic repeats the sequence routine from step S110 where the valve position flag Fcls is reset down. That is, in the event where the state that the target valve opening Vt is greater than the prescribed critical point Va for a time longer than the specified time T2D (a slightly short time period of closed state of the exhaust gas recirculation (EGR) valve 18 can be regarded as part of continuation of the state), the diaphragm 36 is continuously applied with tension due to a pressure in the upper pressure chamber 40 of the exhaust gas recirculation (EGR) valve 18 greater than a prescribed critical point. Consequently, the event where, while the diaphragm 36 remains elastically deformable or flexible, the absolute value of the deviation ΔVt becomes greater than the prescribed critical point Vc is regarded as a result from wrong valve operation of the exhaust gas recirculation (EGR) valve 18 due to causes other than hardening of the diaphragm 36. Based on this consideration, it is concluded that the exhaust gas recirculation (EGR) valve 18 is at failure in opening and closing valve operation when the timer count T2 is greater than the specified time T2D. On the other hand, when the timer count T2 is less than the specified time T2D, which indicates that the diaphragm 36 has possibly been hardened or lost flexibility due to low temperatures, the flow chart logic repeats the sequence routine from step S110 until the timer count T2 exceeds the specified time T2D. The situation of valve operation of the exhaust gas recirculation (EGR) valve 18 is stored in the memory of the control unit 47 at step S131. The data of the situation of valve operation of the exhaust gas recirculation (EGR) valve 18 is read out for service by means of a tester that is connected to the control unit 47 in a service station. The control unit 47 may be adapted so that it is caused by the tester to instantaneously drive the exhaust gas recirculation (EGR) valve 18, in particular the pintle valve 33, to its full position. Valve operation of the exhaust gas recirculation (EGR) valve 18 is simply verified with a sound generated by the pintle valve 33. While it is possible to make verification of valve operation of the exhaust gas recirculation (EGR) valve 18 by means of an indication of the position sensor 15, because the position sensor 15 is generally designed and adapted to detect only positions of the pintle valve 33 less than the full position, it is hard to make use of the position sensor 15 for verification of opening and closing valve operation of the exhaust gas recirculation (EGR) valve 18.

In valve operation of the valve operation verification system of the invention, when a target valve opening Vt of the exhaust gas recirculation (EGR) valve 18 calculated according to an engine operating condition is smaller than the prescribed critical point Va, or when, while the target valve opening Vt of the exhaust gas recirculation (EGR) valve 18 is greater than the prescribed critical point Va, the condition for execution of verification of opening and closing valve operation of the exhaust gas recirculation (EGR) valve 18 has not yet been satisfied, the exhaust gas recirculation (EGR) valve 18 is forced to open to the target valve opening Vt and regulate an exhaust gas flow circulating into the intake passage 2. On the other hand, when the target valve opening Vt of the exhaust gas recirculation (EGR) valve 18 is greater than the prescribed critical point Va and the condition for execution of verification of opening and closing valve operation of the exhaust gas recirculation (EGR) valve 18 has not yet been satisfied, the exhaust gas recirculation (EGR) valve 18 is forced to open to the monitoring target valve opening Vtopn having a value near the greatest or full valve opening. At this time, the deviation ΔVt of the actual valve opening V from the monitoring target valve opening Vtopn and the pressure Pon in the exhaust gas recirculation passage 17 with the exhaust gas recirculation (EGR) valve 18 remaining open are read. The pressure Pon is equal to the pressure of exhaust gas. Subsequently, the exhaust gas recirculation (EGR) valve 18 is forced to close, and the pressure Poff in the exhaust gas recirculation passage 17 with the exhaust gas recirculation (EGR) valve 18 remaining closed is read. At this time, because the pressure Poff is equal to the pressure in the surge tank which is negative, the pressure Pon is greater than the pressure Poff. When the pressure difference of the pressure Pon from the pressure Poff is greater than the prescribed critical point Pb, the exhaust gas recirculation (EGR) valve 18 is regarded as operating normally. On the other hand, when the pressure difference of the pressure Pon from the pressure Poff is smaller than the prescribed critical point Pb, it is not always suitable to jump to the conclusion on a basis of the pressure difference that the exhaust gas recirculation (EGR) valve 18 is at failure in opening and closing valve operation. This is because, the exhaust gas recirculation (EGR) valve 18 might be at failure in opening and closing valve operation and, on the other hand, there is the possibility of low temperature hardening of the diaphragm 36 or loss in flexibility of the diaphragm 36 and/or the possibility of freezing of the pressure sensor 14 if the temperature of intake air Tha is lower than 10° C. For this reason, the determination as to whether the temperature of intake air Tha is higher than 10° C. is made and it is concluded, if higher than 10° C., that the exhaust gas recirculation (EGR) valve 18 has been led to inadequate valve operation due to causes other than hardening of the diaphragm 36 or loss in flexibility of the diaphragm 36 or due to clogging between the valve seat 32 and the pintle valve 33.

When the temperature of intake air Tha is lower than 10° C., the determination as to freezing of the pressure sensor 14 is made. If the pressure sensor 14 has frozen, it is difficult to perform precise verification of opening and closing valve operation of the exhaust gas recirculation (EGR) valve 18, and the sequence routine is re-executed from reading in the temperature of intake air Tha after having driven the exhaust gas recirculation (EGR) valve 18 until it attains the target valve opening Vt. If the pressure sensor 14 remains free from freezing, it is determined whether the diaphragm 36 remains sufficiently flexible. The determination as to whether the absolute value of the deviation ΔVt of the actual valve opening V from the monitoring target valve opening Vtopn is smaller than the prescribed critical point Vc is made. When the absolute value of the deviation ΔVt of the actual valve opening V from the monitoring target valve opening Vtopn is smaller than the prescribed critical point Vc, it is concluded that, while the diaphragm 36 is warmed with heated exhaust gas recirculating into the intake passage 2 and regains the flexibility or elasticity as specified to operate normally the pintle valve 33, there has occurred clogging between the valve seat 32 and the pintle valve 33, which causes inadequate operation of the exhaust gas recirculation (EGR) valve 18. Succeedingly, when the absolute value of the deviation ΔVt of the actual valve opening V from the monitoring target valve opening Vtopn is greater than the prescribed critical point Vc, the determination as to whether the state that the target valve opening Vt is greater than the prescribed critical point Va continuously takes place for a longer time than the specified time T2D. When the state continuously takes place for a longer time than the specified time T2D, it is concluded that the diaphragm 36 remains flexible and the deviation ΔVt of the actual valve opening V from the monitoring target valve opening Vtopn greater than the prescribed critical point Vc results from inadequate valve operation of the exhaust gas recirculation (EGR) valve 18 caused by parts or elements other than the diaphragm 36. Because there is the potential of hardening of the diaphragm 36 due to low temperatures until the specified time T2D is exceeded, the sequence routine is re-executed from reading in the temperature of intake air Tha after having driven the exhaust gas recirculation (EGR) valve 18 until it attains the target valve opening Vt.

As described above, with the valve operation verification system of the invention which comprises the exhaust gas recirculation (EGR) valve 18 of the type having a diaphragm 36 which forces the pintle valve 33 according to a change in pressure in the pressure chamber 40 to regulate the amount of exhaust gas flowing through the exhaust gas recirculation passage 17, and valve operational failure detection means for detecting hardening or loss in flexibility of the diaphragm 36 due to low temperatures, detecting freezing of the pressure sensor 14 to detect pressure in the exhaust gas recirculation passage 17 downstream from the exhaust gas recirculation (EGR) valve 18, and verifying valve operation of the exhaust gas recirculation (EGR) valve 18 according to changes in pressure in the exhaust gas pressure caused due to opening and closing valve operation of the exhaust gas recirculation (EGR) valve 18 and detected by the pressure sensor 14 under the condition that, while the temperature of ambient air is lower than a prescribed critical point and the temperature of engine cooling water is higher than a prescribed critical point, it is concluded that the diaphragm 36 remains flexible and the pressure sensor 14 remains free from freezing, the verification of opening and closing valve operation of the exhaust gas recirculation (EGR) valve 18 is executed even when the temperature of ambient air is lower than the prescribed critical point. This can be of great merit because there is the possibility that the diaphragm remains flexible even under ambient air temperatures lower than the prescribed critical point. Further, because the verification of valve operation of the exhaust gas recirculation (EGR) valve 18 is executed when it is concluded that the diaphragm remains flexible and the pressure sensor remains free from freezing, execution of the verification of valve operation of the exhaust gas recirculation (EGR) valve 18 is accurate. Consequently, there is an increased chance of execution of the verification of valve operation of the exhaust gas recirculation (EGR) valve 18, which is always desirable for early and timely detection of a failure in valve operation.

With the valve operation verification system described above, because it is concluded that the diaphragm 36 remains flexible when the exhaust gas recirculation (EGR) valve 18 has the deviation ΔVt of the actual valve opening V from a monitoring target valve opening Vtopn smaller than the prescribed critical point Vc or when, while the exhaust gas recirculation (EGR) valve 18 has the deviation ΔVt of the actual valve opening V from a monitoring target valve opening Vtopn larger than the prescribed critical point Vc, the state that the target valve opening Vt is greater than the prescribed critical point Va continuously takes place for a longer time than the specified time T2D, the verification of opening and closing valve operation of the exhaust gas recirculation (EGR) valve 18 is accurate even in the event where the exhaust gas recirculation (EGR) valve 18 encounters inadequate valve operation due to factors other than hardening of the diaphragm 36 or where the exhaust gas recirculation (EGR) valve 18 gets clogged with foreign particles between the valve seat 32 and the pintle valve 33. This leads to prompt and accurate verification of valve operation of the exhaust gas recirculation (EGR) valve 18.

Figure 6:
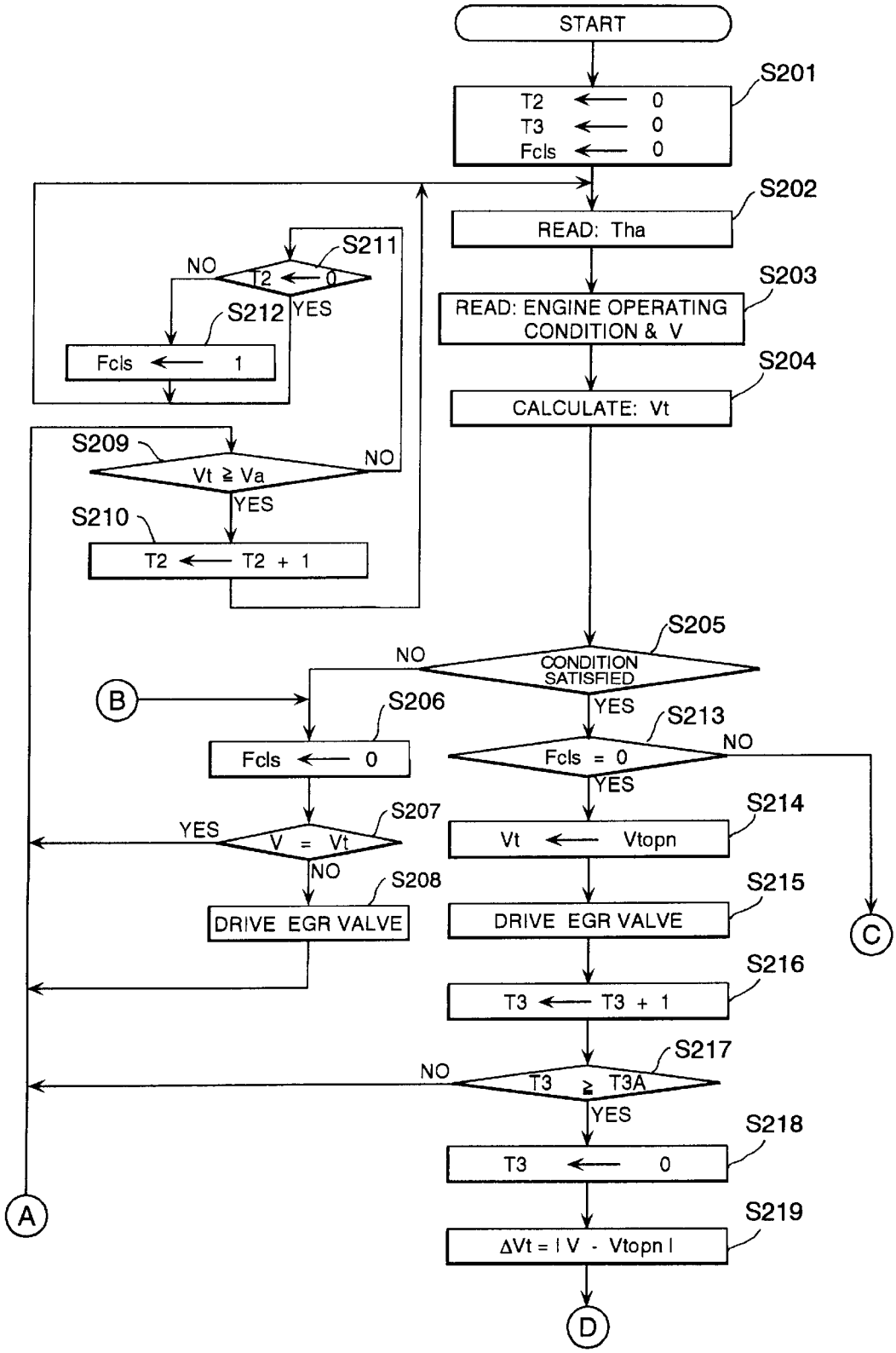
FIGS. 6 and 7 are a flow chart illustrating a variation of the sequence routine of verifying operation of the exhaust gas recirculation valve shown in FIGS. 4 and 5.
Figure 7:
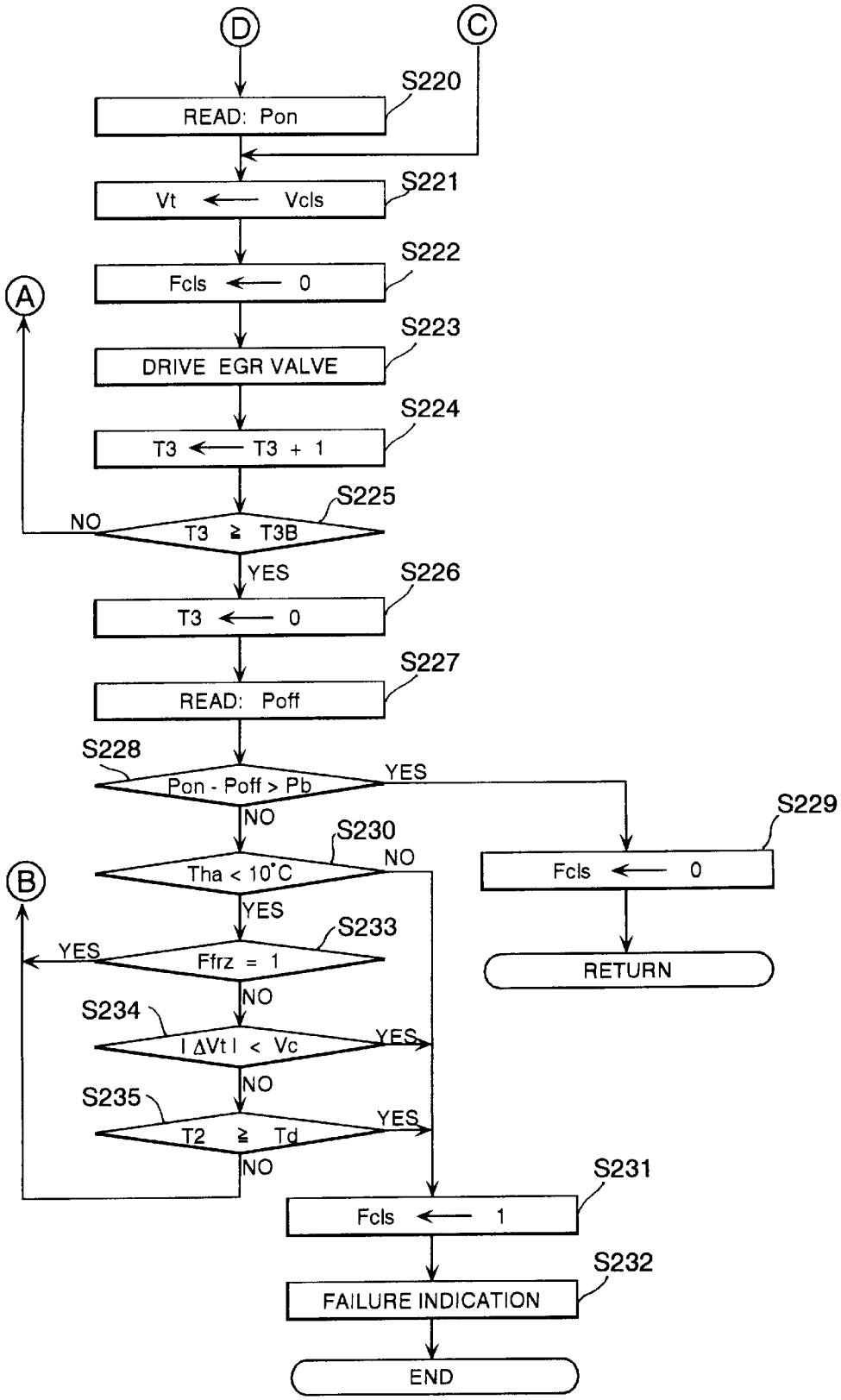

FIGS. 6 and 7 are flow charts illustrating respectively a variation of the sequence routine of valve operation verification shown in FIGS. 4 and 5, in which it is verified from the fact that the state that the actual valve opening V greater than the prescribed critical point Va continuously takes place for longer than the specified time T2D that the diaphragm 36 of the exhaust gas recirculation (EGR) valve 18 remains elastically deformable or flexible.

Specifically, as shown in FIGS. 6 and 7, when the flow chart logic commences and control proceeds to a function block at step S201 where timer counts T2 and T3, each of which indicates a time lapse, are reset to 0 (zero), and a valve position flag Fcls is reset down or to the state of zero (0). Subsequently, after reading in the temperature Tha of intake air passing through the air flow sensor 5 on a basis of a signal from the air flow is sensor 5 at step S202, a current engine operating condition and a vertical lift position representative of actual valve opening of the exhaust gas recirculation (EGR) valve 18 are detected on a basis of signals from the air-flow sensor 5, the water temperature sensor 11, the engine speed sensor 12 and the throttle position sensor 13, and a basis of a signal from the position sensor 15, respectively, at step S203. After calculating target valve opening Vt of the exhaust gas recirculation (EGR) valve 18 according to the engine operating condition at step S204, a determination is made at step S205 as to whether a condition for execution of verification of opening and closing valve operation of the exhaust gas recirculation (EGR) valve 18 as described in the previous embodiment has been satisfied. If the execution condition is not yet satisfied, after resetting the valve position flag Fcls to the state of "0," this indicates that the exhaust gas recirculation (EGR) valve 18 remains closed, at step S206, another determination is made at step S207 as to whether the exhaust gas recirculation (EGR) valve 18 has actual valve opening V equal to the target valve opening Vt. The exhaust gas recirculation (EGR) valve 18 is driven until it is actually opened to the target valve opening Vt at step S208. When the exhaust gas recirculation (EGR) valve 18 is actually opened to the target valve opening Vt, a determination is made at step S209 as to whether the actual valve opening V is equal to or greater than a prescribed critical point Va. When the actual valve opening V is equal to or greater than the prescribed critical point Va, after changing the timer count T2 by an increment of 1 (one) at step S210, the flow chart logic returns and restarts the sequence routine from step S202. On the other hand, when the actual valve opening V is less than the prescribed critical point Va at step S209 and the valve position flag Fcls is up, which indicates that the exhaust gas recirculation (EGR) valve 18 remains open, at step S211 or after resetting the timer count T2 to 0 (zero) at step S212 when the actual valve opening V is less than the prescribed critical point Va at step S209 and the valve position flag Fcls is down at step S211, the flow chart logic returns and restarts the sequence routine from step S202.

If the execution condition is satisfied, another determination is made at step S213 as to whether the valve position flag Fcls is down. If the answer to the determination is "YES," the target valve opening Vt is replaced with a prescribed monitoring target valve opening Vtopn at step S214. Subsequently, the exhaust gas recirculation (EGR) valve 18 is driven until it retains opening equal to the monitoring target valve opening Vtopn at step S215. After changing the timer count T3 by an increment of 1 (one) at step S216, the timer count T3 is compared to a specified time T3A at step S217. If the timer count T3 indicates a time lapse less than the specified time T3A, the flow chart logic orders return to step S209 where the determination of the actual valve opening with respect to the target valve opening Vt is made. On the other hand, if the timer count T3 indicates a time lapse equal to or greater than the specified time T3A, after resetting the timer count T3 to 0 (zero) at step S218, a deviation ΔVt of the actual valve opening V from the monitoring target valve opening Vtopn and the pressure Pon in the exhaust gas recirculation passage 17 with the exhaust gas recirculation (EGR) valve 18 remaining open are read in at steps S219 and S220, respectively. Thereafter, at step S221, the target valve opening Vt is changed to the smallest valve opening Vcls of the exhaust gas recirculation (EGR) valve 18 at a closed position. If the answer to the determination regarding the valve position flag Fcls made at step S213 is "NO," this indicates that the exhaust gas recirculation (EGR) valve 18 remains open, then, the flow chart logic skips steps S214 through S220 and proceeds to step S221 to change the target valve opening Vt to the smallest valve opening Vcls of the exhaust gas recirculation (EGR) valve 18.

Subsequently to changing the target valve opening Vt to the smallest valve opening Vcls of the exhaust gas recirculation (EGR) valve 18 at step S221 and setting up the valve position flag Fcls at step S222, the exhaust gas recirculation (EGR) valve 18 is driven to close at step S223, and the timer count T3 is changed by an increment of 1 (one) at step S224. At step S225, the timer count T3 is compared to a specified time T3B. If the timer count T3 indicates a time lapse less than the specified time T3B, the flow chart logic orders return to step S209 where the determination of the actual valve opening V with regard to the target valve opening Vt is made. On the other hand, if the specified time T3B has lapsed, i.e. the answer to the decision made at step S225 turns "YES," then, after resetting the timer count T3 to 0 (zero) at step S226, the pressure Poff in the exhaust gas recirculation passage 17 with the exhaust gas recirculation (EGR) valve 18 remaining closed is read in at step S227. A determination is subsequently made at step S228 as to the difference of the pressure in the exhaust gas recirculation passage 17 while the exhaust gas recirculation (EGR) valve 18 remains open and while the exhaust gas recirculation (EGR) valve 18 remains closed and compared to a prescribed critical point Pb. If the pressure difference (Pon−Poff) is greater than the prescribed critical point Pb, it is concluded that the exhaust gas recirculation (EGR) valve 18 is normal in opening and closing valve operation, and then, at step S129, a valve operation flag Fcls is reset down or reset to a state of "0" which indicates that the exhaust gas recirculation (EGR) valve 18 is normal in valve operation. On the other hand, if the pressure difference (Pon−Poff) is smaller than the prescribed critical point Pb, another determination is made at step S230 as to whether the temperature of intake air passing through the air flow sensor 5 is lower than a prescribed critical point of, for example, 10° C. If the temperature of intake air Tha is higher than the prescribed critical point of 10° C., it is concluded that the exhaust gas recirculation (EGR) valve 18 is at failure in opening and closing valve operation, then, the valve operation flag Fcls is set to the state of "1" which indicates that the exhaust gas recirculation (EGR) valve 18 is at failure in valve operation at step S231. Thereafter, after making an indication of a failure in valve operation by means of, for example, an alarm lamp at step S232, the flow chart logic terminates the sequence routine.

When the temperature of intake air Tha is lower than the prescribed critical point of 10° C., a determination is made at step S233 as to whether the freeze flag Ffrz has been set to the state of "1" which indicates that the pressure sensor 14 has frozen abnormally operative. If the answer to the determination is "YES," the flow chart logic orders return to step S206 where the valve position flag Fcls is reset down. On the other hand, when the answer to the determination regarding the freeze flag Ffrz made at step S233 is "NO," a determination is made at step S234 as to whether the absolute value of the deviation ΔVt of the actual valve opening V from the monitoring target valve opening Vtopn is smaller than a prescribed critical point Vc. When the absolute value of the deviation ΔVt is smaller than the prescribed critical point Vc, it is concluded that, though the temperature of intake air Tha is lower than the prescribed critical point of 10° C., the exhaust gas recirculation (EGR) valve 18 operates normally with the diaphragm 36 remaining elastically deformable or flexible and has, however, gotten clogged with foreign particles between the valve seat 32 and the pintle valve 33. In such the event, it is verified that the exhaust gas recirculation (EGR) valve 18 is at failure in opening and closing valve operation, then, the valve operation flag Fcls is set to the state of "1" which indicates that the exhaust gas recirculation (EGR) valve 18 is at failure in valve operation at step S231. Thereafter, after making an indication of a failure in valve operation by means of the alarm lamp at step S232, the flow chart logic terminates the sequence routine. On the other hand, when the absolute value of the deviation ΔVt of the actual valve opening V from the monitoring target valve opening Vtopn is greater than the prescribed critical point Vc, a determination is further made at step S235 as to whether the timer count T2 is equal to or greater than a specified time T2D which is set forth between, for example, two to five seconds. When the timer count T2 remains less than the specified time T2D, the flow chart logic orders return to step S206 where the valve position flag Fcls is reset down. On the other hand, when the timer count T2 exceeds the specified time T2D, it is concluded that the exhaust gas recirculation (EGR) valve 18 is at failure in opening and closing valve operation, then, the valve operation flag Fcls is set to the state of "1" which indicates that the exhaust gas recirculation (EGR) valve 18 is at failure in valve operation at step S231. After making an indication of a failure in valve operation by means of the alarm lamp at step S232, the flow chart logic terminates the sequence routine.

As described above, in the sequence routine shown in FIGS. 6 and 7, while the exhaust gas recirculation (EGR) valve 18 has actual valve opening greater than the prescribed critical point Va, the timer count T2 is continuously changed up and, when the timer count T2 reaches the specified time T2D, this indicates that the diaphragm 36 is continuously applied with tension greater than a prescribed critical point for a time period longer than a specified time, it is concluded that the diaphragm 36 remains still elastically deformable or flexible as designed. From the fact, it is concluded that the exhaust gas recirculation (EGR) valve 18 is normal in opening and closing valve operation. With the valve operation verification system, the verification of opening and closing valve operation of the exhaust gas recirculation (EGR) valve 18 is accurate even in the event where the exhaust gas recirculation (EGR) valve 18 encounters inadequate valve operation due to factors other than hardening of the diaphragm 36 or where the exhaust gas recirculation (EGR) valve 18 gets clogged with foreign particles between the valve seat 32 and the pintle valve 33. This leads to prompt and accurate verification of valve operation of the exhaust gas recirculation (EGR) valve 18.

Figure 8:
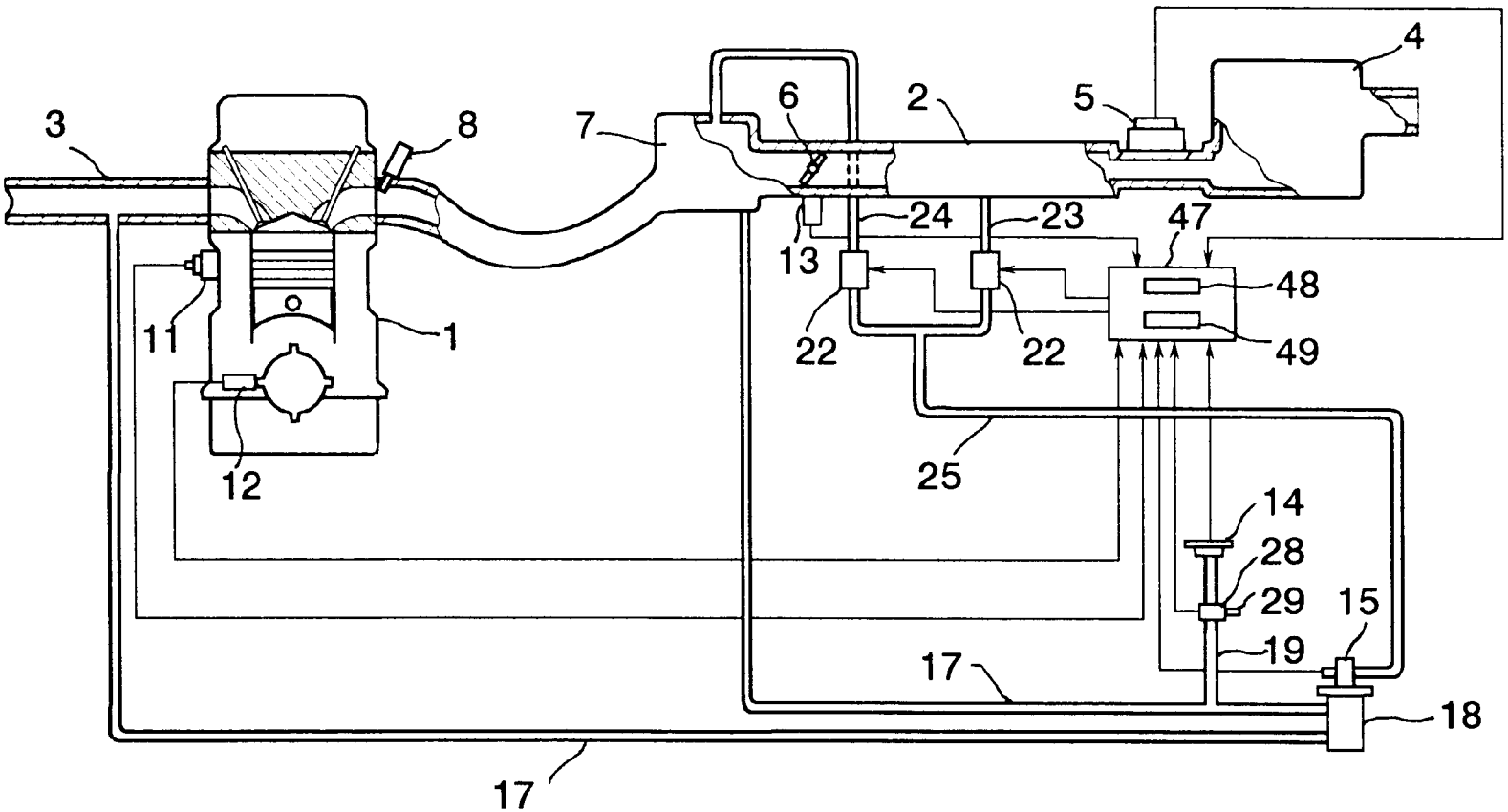
FIG. 8 is a schematic illustration showing an exhaust gas recirculation system equipped with a valve operation verifying system for use with an automobile engine in accordance with another embodiment of the present invention.

FIG. 8 shows an exhaust gas recirculation system, having an exhaust gas recirculation passage 17, equipped with a valve operation verifying system for the exhaust gas recirculation system in accordance with another embodiment of the invention which is similar to that of the previous embodiment and is, however, adapted such that a pressure sensor 14 detects pressure in the exhaust gas recirculation passage 17 and ambient air pressure, selectively.

Specifically, the exhaust gas recirculation passage 17 incorporates a switching valve 18 as an exhaust gas recirculation (EGR) valve. A branch passage 19 branches off from downstream part of the exhaust gas recirculation passage 17 between a surge tank 7 and the exhaust gas recirculation (EGR) valve 18 so as to be applied with exhaust gas circulating into the surge tank 7 and has an air circulation passage 29 through which ambient air is introduced into the branch passage 19. A pressure sensor 14 is attached to an end of the branch passage 19, and a switching valve 28 is disposed in the branch passage 19 at the junction of the air circulation passage 29. The switching valve 28 is used to admit selectively exhaust gas and ambient air to be directed to the pressure sensor 14.

Figure 9:
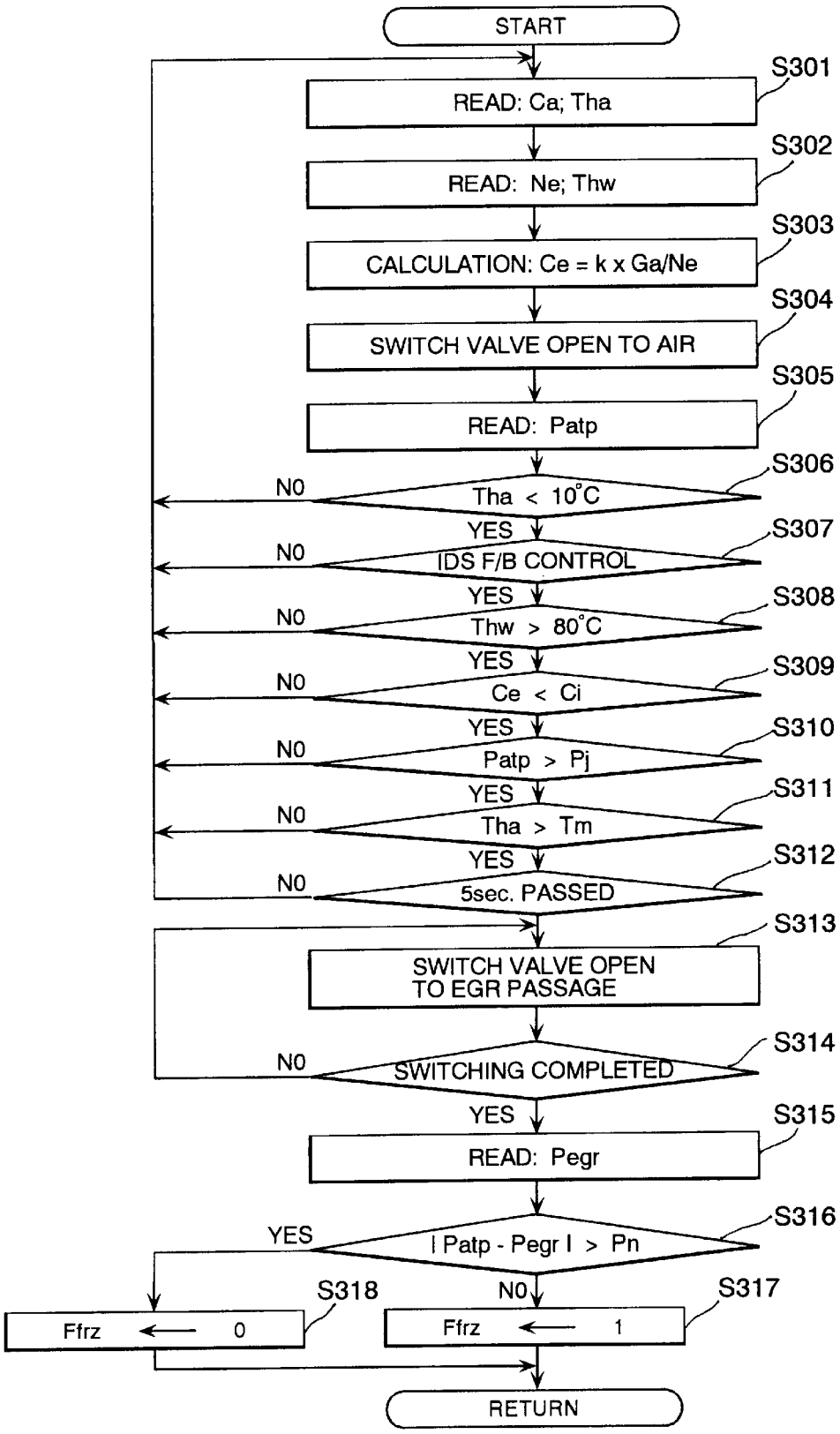
FIG. 9 is a flow chart illustrating a sequence routine of verifying operation of a pressure sensor suitable for the exhaust gas recirculation system shown in FIG. 8.

Monitoring of valve operation of the pressure sensor 14 is performed following a sequential routine for the programmed microcomputer of the control unit 47 illustrated by a flow chart shown in FIG. 9.

Referring to FIG. 9, when the flow chart logic commences and control passes directly to a function block at step S301 where the amount of intake air Ga and the temperature of intake air Tha are detected on a basis of a signal from an air flow meter or sensor 5. Subsequently, a current engine operating condition, including the rotational speed Ne of the engine 1 and the temperature of engine cooling water Thw, is detected on a basis of signals from the water temperature sensor 11 and the engine speed sensor 12 at step S302. At step S303, an air charging efficiency Ce is calculated by dividing the amount of intake air Ga by the engine speed Ne and multiplying the quotient by an invariable k. The switching valve 28 is switched to shut off exhaust gas and introduce ambient air through the air circulation passage 29 at step S304, and the atmospheric pressure Patp is detected on a basis of a signal from the pressure sensor 14 at step S305. These data are sampled at regular intervals of, for example, 20 ms. Thereafter, determinations are subsequently made to decide whether the condition for execution of verification of valve operation of the pressure sensor 14 has been satisfied at steps S306 through S312. The answers to the determinations are "YES," it is concluded that the execution condition is satisfied. When the answer to any one of the determinations is "NO," then, the flow chart logic orders return and restarts another sequence routine. Specifically, a determination is made at step S306 as to whether the temperature of intake air Tha is lower than a prescribed critical point of, for example in this embodiment, 10° C. When the temperature of intake air Tha is lower than a prescribed critical point of 10° C., a determination is made at step S307 as to whether an idle speed of the engine is under feedback control. In the event where the idle speed feedback control is being executed, a determination is made at step S308 as to whether the temperature of engine cooling water Thw is higher than a prescribed critical point of, for example in this embodiment, 80° C. When higher than the prescribed critical point of 80° C., a determination is made at step S309 as to whether the air charging efficiency Ce is smaller than a prescribed critical air charging efficiency Ci. When smaller than the prescribed critical air charging efficiency Ci, a determination is made at step S310 as to whether the atmospheric pressure Patp is higher than a prescribed critical point Pj. When higher than the prescribed critical point Pj, a determination is subsequently made at step S311 as to whether the temperature of intake air Tha is higher than a prescribed critical point Tm. When higher than the prescribed critical point Tm, a determination is further made at step S312 as to whether a prescribed time period of, for example in this embodiment, five minutes has passed.

When the execution condition is satisfied, after switching the switching valve 28 to shut off ambient air and introduce exhaust gas from the exhaust gas recirculation passage 17 at step S313, a determination is made at step S314 as to completion of a switch of the switching valve 28. This determination is repeated until the switching of the switching valve 28 is completed. Subsequently, after reading in a current exhaust gas pressure Pegr in the exhaust gas recirculation passage 17 on a basis of a signal from the pressure sensor 14 at step S315, the absolute value of a pressure difference between the atmospheric pressure Patp and the exhaust gas pressure Pegr is compared to a prescribed critical point Pn of, for example in this embodiment, 100 mmHg at step S316. When the pressure difference (Patp−Pegr) is smaller than the critical point Pn of 100 mmHg, it is concluded that the pressure sensor 14 has been frozen abnormally operative and then a freeze flag Ffrz is set up at step S317. On the other hand, when the pressure difference (Patp−Pegr) is greater than the critical point Pn of 100 mmHg, it is concluded that the pressure sensor 14 remains normally operative and then the freeze flag Ffrz is reset down at step S318. After setting up or resetting down the freeze flag Ffrz, the flow chart logic orders return.

These conclusions are based on the fact that the exhaust gas pressure Pegr in the exhaust gas recirculation passage 17 is equal to the negative pressure in the surge tank 7 while the exhaust gas recirculation (EGR) valve 18 fully closes and becomes higher than the atmospheric pressure Patp while the exhaust gas recirculation (EGR) valve 18 opens. With the sequence routine of verifying valve operation of the pressure sensor 14 in which alternate detection of exhaust gas pressure and atmospheric pressure is performed and valve operation of the pressure sensor 14 is verified on a basis of the difference between these exhaust gas pressure and atmospheric pressure, the verification of valve operation of the pressure sensor 14 is accurate even though it is achieved in a shortened time.

While the valve operation verifying system for an exhaust gas recirculation system in accordance with the respective embodiments described above is designed and adapted such that the verification of valve operation of the exhaust gas recirculation (EGR) valve 18 is interrupted when it is verified that the diaphragm 36 loses the elasticity or flexibility, nevertheless, the verification of valve operation of the exhaust gas recirculation (EGR) valve 18 may be made on a basis of the frequencies of conclusions that the diaphragm 36 remains elastically deformable or flexible and conclusions that it is hardened. That is, when the number of times counted before the last verification that the diaphragm 36 is not elastically deformable or flexible as specified is obtained is greater by a specified number of times than the number of times counted before the last verification that the diaphragm 36 remains elastically deformable or flexible is obtained, it is verified that the exhaust gas recirculation (EGR) valve 18 is at failure in valve operation.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of the invention.

What is claimed is:

1. A valve operation verifying system for verifying opening and closing operation of a gas flow control valve of a type having a valve body and an elastic body elastically deformable to force the valve body to variably open and close a gas passage so as to control the amount of hot gas admitted to flow through the gas passage, said valve operation verifying system comprising:

a temperature sensor for detecting a temperature of ambient air; and verifying means for verifying whether said elastic body remains elastically deformable as specified and executing verification of opening and closing valve operation of said gas flow control valve based on a shut-off state of said gas passage when verifying that said elastic body remains elastically deformable as specified while said temperature sensor detects temperatures of ambient air lower than a specified critical point.

2. The valve operation verifying system as defined in claim 1, wherein said gas passage forms an exhaust gas recirculation passage interposed between an intake passage and an exhaust passage of an automobile engine and said gas flow control valve controls the amount of hot exhaust gas admitted to recirculate into said intake passage according to engine operating conditions.

3. The valve operation verifying system as defined in claim 2, and further comprising a valve opening sensor to detect an actual valve opening of said gas flow control valve, wherein said verifying means further calculates a target valve opening of said gas flow control valve based on an engine operating condition and verifies that said elastic body remains elastically deformable as specified when either one of said actual valve opening and said target valve opening remains greater than a specified critical point for a time period longer than a specified time period.

4. The valve operation verifying system as defined in claim 2, and further comprising an valve opening sensor to detect an actual valve opening of said gas flow control valve, wherein said verifying means further calculates a target valve opening of said gas flow control valve based on an engine operating condition and verifies that said elastic body remains elastically deformable as specified when a deviation of said actual valve opening from said target valve opening is within specified critical limits.

5. The valve operation verifying system as defined in claim 2, and further comprising a valve opening sensor to detect an actual valve opening of said gas flow control valve, wherein said verifying means further calculates a target valve opening of said gas flow control valve based on an engine operating condition and verifies that said elastic body remains elastically deformable as specified when, while either one of said actual valve opening and said target valve opening remains greater than a specified critical point for a time period longer than a specified time period, a deviation of said actual valve opening from said target valve opening is within specified critical limits.

6. The valve operation verifying system as defined in claim 2, and further comprising a pressure sensor disposed in said exhaust gas recirculation passage downstream from said gas flow control valve to detect gas pressure in said exhaust gas recirculation passage, wherein said verifying means verifies whether said pressure sensor remains free from freezing on a basis of said gas pressure and executes said verification of opening and closing valve operation of said gas flow control valve on a basis of a change in said gas pressure between while said gas flow control valve opens and while said gas flow control valve closes and further verifies that said pressure sensor remains free from freezing.

7. The valve operation verifying system as defined in claim 6, and further comprising a valve opening sensor to detect an actual valve opening of said gas flow control valve, wherein said verifying means further calculates a target valve opening of said gas flow control valve based on an engine operating condition and verifies that said elastic body remains elastically deformable as specified when either one of said actual valve opening and said target valve opening remains greater than a specified critical point for a time period longer than a specified time period.

8. The valve operation verifying system as defined in claim 6, and further comprising an valve opening sensor to detect an actual valve opening of said gas flow control valve, wherein said verifying means further calculates a target valve opening of said gas flow control valve based on an engine operating condition and verifies that said elastic body remains elastically deformable as specified when a deviation of said actual valve opening from said target valve opening is within specified critical limits.

9. The valve operation verifying system as defined in claim 6, and further comprising a valve opening sensor to detect an actual valve opening of said gas flow control valve, wherein said verifying means further calculates a target valve opening of said gas flow control valve based on an engine operating condition and verifies that said elastic body remains elastically deformable as specified when either one of said actual valve opening and said target valve opening remains greater than a specified critical point for a time period longer than a specified time period, a deviation of said actual valve opening from said target valve opening is within specified critical limits.

10. The valve operation verifying system as defined in claim 6, and further comprising a temperature sensor to detect a temperature of engine coolant water, wherein said verifying means executes said verification of opening and closing valve operation of said gas flow control valve while said temperature of engine coolant water remains higher than a specified critical point.

11. A valve operation verifying system for verifying opening and closing operation of an exhaust gas recirculation valve incorporated in an exhaust gas recirculation passage to admit controlled amounts of exhaust gas that is recirculated into an intake air stream, said exhaust gas recirculation valve comprising a valve body and a diaphragm elastically deformable according to operating conditions of an automobile engine to actuate the valve body, said valve operation verifying system comprises:

a temperature sensor for detecting a temperature of ambient air;

a pressure sensor disposed in said exhaust gas recirculation passage downstream from said exhaust gas recirculation valve to detect gas pressure in said exhaust gas recirculation passage; and a control unit comprising a microcomputer to verify on a basis of said gas pressure whether said diaphragm remains elastically deformable as specified and whether said pressure sensor remains free from freezing, and to execute verification of opening and closing operation of said exhaust gas recirculation valve on a basis of a change in said gas pressure between when said exhaust gas recirculation valve opens and when said exhaust gas recirculation valve closes, while said temperature sensor detects temperatures of ambient air lower than a specified critical point, verifying that said diaphragm remains elastically deformable as specified and that said pressure sensor is free from freezing.

12. The valve operation verifying system as defined in claim 11, and further comprising a valve opening sensor to detect an actual valve opening of said exhaust gas recirculation valve, wherein said verifying means further calculates a target valve opening of said exhaust gas recirculation valve based on an engine operating condition and verifies that said elastic body remains elastically deformable as specified when either one of said actual valve opening and said target valve opening remains greater than a specified critical point for a time period longer than a specified time period.

13. The valve operation verifying system as defined in claim 11, and further comprising-an valve opening sensor to detect an actual valve opening of said exhaust gas recirculation valve, wherein said verifying means further calculates a target valve opening of said exhaust gas recirculation valve based on an engine operating condition and verifies that said elastic body remains elastically deformable as specified when a deviation of said actual valve opening from said target valve opening is within specified critical limits.

14. The valve operation verifying system as defined in claim 11, and further comprising a valve opening sensor to detect an actual valve opening of said exhaust gas recirculation valve, wherein said verifying means further calculates a target valve opening of said exhaust gas recirculation valve based on an engine operating condition and verifies that said elastic body remains elastically deformable as specified when, while either one of said actual valve opening and said target valve opening remains greater than a specified critical point for a time period longer than a specified time period, a deviation of said actual valve opening from said target valve opening is within specified critical limits.

* * * * *